US005094543A

United States Patent [19]

Mursa

[11] Patent Number: 5,094,543

[45] Date of Patent: Mar. 10, 1992

[54] PAINT MIXING CONTAINER

[76] Inventor: Laszlo Mursa, 4279 Lakeshore Road, Kelowna, British Columbia, Canada, V1W 1W2

[21] Appl. No.: 519,892

[22] Filed: May 7, 1990

Related U.S. Application Data

[63] Continuation-in-part of Ser. No. 216,776, Jul. 8, 1988, Pat. No. 4,926,390.

[30] Foreign Application Priority Data

Jul. 8, 1987 [CA] Canada ..... 541633

[51] Int. Cl.[5] ..... B01F 7/24; B65D 47/14

[52] U.S. Cl. ..... 366/247; 220/298; 220/306; 220/403; 220/410; 222/572; 366/249; 366/281; 366/282; 366/312; 366/320; 366/347; 366/605

[58] Field of Search ..... 366/279-285, 366/241, 242, 244-254, 130, 310, 311, 347, 312, 605, 214; 220/402, 403, 404, 408, 410, 447, 85 SP, 470, 306, 298; 222/570-572, 470, 517; 215/332

[56] References Cited

U.S. PATENT DOCUMENTS

| | | | |
|---|---|---|---|
| 411,870 | 10/1889 | Mulford | 366/252 |
| 413,546 | 8/1889 | Pearl . | |
| 793,844 | 7/1905 | Libbman | 366/331 |
| 819,799 | 5/1906 | Reams | 248/213.2 X |
| 871,988 | 11/1907 | Fay . | |
| 912,842 | 2/1909 | Griffiths . | |
| 975,542 | 11/1910 | Letherbury | 222/572 X |
| 1,344,836 | 6/1920 | Walden . | |
| 1,698,402 | 1/1929 | Harris | 366/605 X |
| 1,775,345 | 9/1930 | Henschel | 366/605 X |
| 2,022,342 | 11/1935 | Drood | 222/572 X |
| 2,038,545 | 4/1936 | Dammert | 222/572 X |
| 2,585,334 | 2/1952 | McCauley | 366/185 X |
| 2,591,578 | 4/1952 | McNealy et al. | 220/447 |
| 2,606,694 | 8/1952 | Galletta | 220/85 SP |
| 3,027,044 | 3/1962 | Winstead | 220/63 |
| 3,041,052 | 6/1962 | Dedoes | 366/247 |
| 3,134,577 | 5/1964 | Bollmeier | 366/64 X |
| 3,272,395 | 9/1966 | Lawyer | 222/570 X |
| 3,371,817 | 3/1968 | Gasbarra et al. | 220/298 |
| 3,820,692 | 6/1974 | Swett et al. | 366/347 |
| 3,858,767 | 1/1975 | Borin | 222/572 X |
| 3,894,650 | 7/1975 | Crump | 222/570 X |
| 3,913,785 | 10/1975 | Pattershall | 222/570 X |
| 3,931,891 | 1/1976 | Peppler | 220/298 X |
| 4,010,934 | 3/1977 | McCord et al. . | |
| 4,050,678 | 9/1977 | Smith | 366/130 |
| 4,122,973 | 10/1978 | Ahern | 220/410 X |
| 4,155,656 | 5/1979 | Kramer | 366/98 |
| 4,240,568 | 12/1980 | Pool | 222/570 X |
| 4,383,635 | 5/1983 | Yotoriyama | 299/1.5 |
| 4,407,584 | 10/1983 | Boudin et al. | 366/279 |
| 4,422,770 | 12/1983 | Geible | 366/248 |
| 4,449,984 | 5/1984 | Cruz | 220/298 X |
| 4,460,279 | 7/1984 | Krasney | 366/247 |
| 4,472,063 | 9/1984 | Eickelmann | 366/129 |
| 4,538,922 | 9/1985 | Johnson | 366/279 X |
| 4,875,781 | 10/1989 | Raska | 366/228 X |
| 4,949,884 | 8/1990 | Dahl | 222/570 |

*Primary Examiner*—Harvey C. Hornsby
*Assistant Examiner*—C. Cooley
*Attorney, Agent, or Firm*—Renner, Kenner, Greive, Bobak, Taylor & Weber

[57] ABSTRACT

A paint mixing container comprising a main body (2) of circular cross section with a base (4), side walls and an open top (6). There is a stirring arm (40) comprising a rotatable central shaft (42) with a helical blade (43, 100) rigidly mounted about the central shaft. As well, there is a removable cover (20) with locking means (12, 52, 70, 72, 73) to allow the cover to be attached to the main body. The removable cover has a sealable opening (22, 69) and means (24) to rotatably support the stirring arm in the interior of the main body.

16 Claims, 3 Drawing Sheets

PAINT MIXING CONTAINER

CROSS REFERENCE TO RELATED APPLICATIONS

The present application is a continuation-in-part of allowed U.S. Ser. No. 216,776, filed July 8, 1988, now U.S. Pat. No. 4,926,390.

TECHNICAL FIELD

This invention relates generally to a paint mixing container and more specifically to a container for mixing automotive paints prior to application.

BACKGROUND ART

Presently, when paint is required, automotive body repair shops use paint mixing systems that require mixing base coat paints in one gallon containers designed for use on a power driven mixing machine. The base paints are in turn mixed in a separate container to create the final desired colour. Thinners and hardeners are added and mixed by hand since it is important that these additives and the paint be thoroughly mixed in order to obtain a good final finish. Each of the mixing containers used must now be thoroughly cleaned using strong industrial chemicals.

DISCLOSURE OF THE INVENTION

The present invention is a paint mixing container comprising:

a main body of circular cross-section with a base, side walls and an open top;

a stirring arm comprising a rotatable central shaft with a helical blade rigidly mounted about said central shaft;

a removable cover for covering the open top of said main body with a sealable opening and means to rotatably support said stirring arm in the interior of the main body; and locking means to allow said removable cover to be removable attached to the open top of said main body.

In a preferred embodiment of the present invention the main body has a capacity of 6.7 liters allowing all the ingredients necessary for preparing a coat of paint to be mixed in a single container. As well, in the preferred embodiment of the present invention, the main body is fitted with a disposable plastic liner which can be discarded after the paint has been mixed thereby saving clean-up time and avoiding the use of potentially harmful cleaning chemicals. The stirring arm of the present invention avoids the present practice of manually stirring the paint and additive mixture and uses a helical blade rotated by a powdered mixer to thoroughly and consistently stir and blend the paint. The sealable opening in the cover of the present invention allows easy pouring of the main body contents or the addition of ingredients to the main body. As well, the sealable opening provides a point of attachment for a spray gun assembly so the final paint preparation can be applied directly from the mixing container thereby minimizing paint spillage.

BRIEF DESCRIPTION OF THE DRAWINGS

The present invention is illustrated, merely by way of example, in the drawings in which:

FIG. 1A is an enlarged fragmentary plan view showing a modified spout and flap;

FIG. 6A is an enlarged fragmentary view showing a spout filter;

FIG. 8A is an enlarged fragmentary elevational view depicting a radial tab on the shaft.

PREFERRED EMBODIMENT FOR CARRYING OUT THE INVENTION

Figure 2:
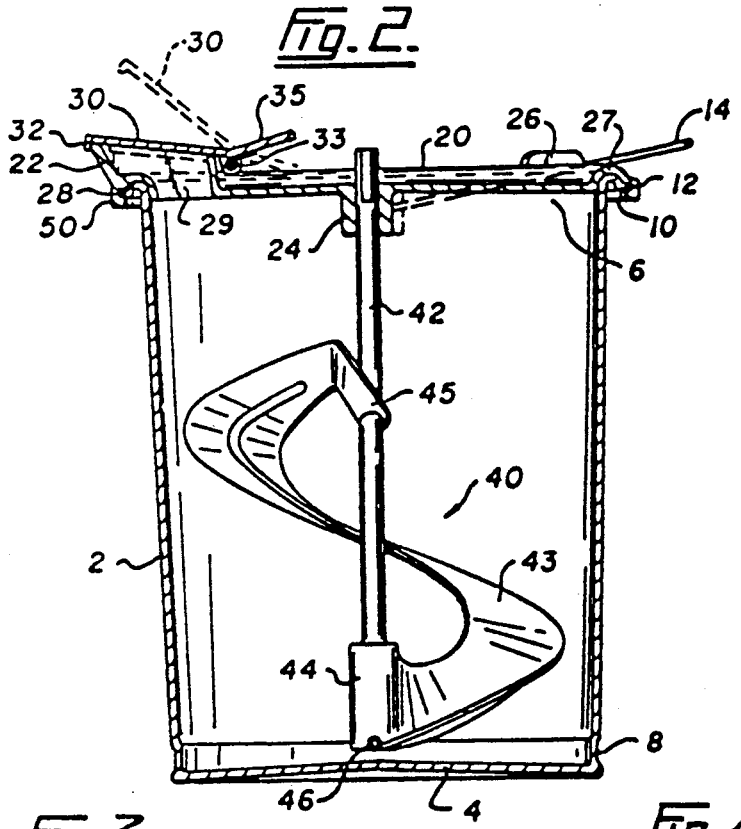
FIG. 2 is a section view of a preferred embodiment of the present invention showing the stirring blade, depicting schematically a power mixer for use therewith.

A preferred embodiment of the present invention is best shown in FIG. 2 and comprises main body 2, removable cover 20 and stirring arm 40.

Figure 3:
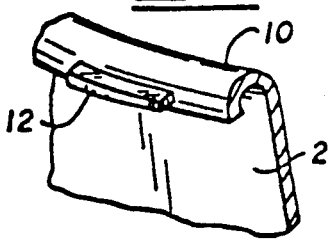
FIG. 3 is a view of the wedge locking tabs of the main body.

Main body 2 is a cylindrical container with a sealed base 4 and an open top 6. Base 4 is shaped as a flattened cone so that the base slopes downwardly from the centre at a two degree angle to the outer edges of the main body. Also toward the base of the main body 2 is circumferential notch 8 to allow the main body to be easily secured to a powered mixer platform. At open top 6, the wall of main body 2 is shaped to form lip 10. Wire handle 14 is mounted to main body 2 by mounting tabs 15 that extend downwardly from lip 10. At spaced intervals around the lower edge lip 10 are wedge shaped tabs 12 projecting outwardly from the lip at shown in FIG. 3. These tabs 12 are part of the locking system which allows removable cover 20 to be sealed atop main body 2.

Figure 1:
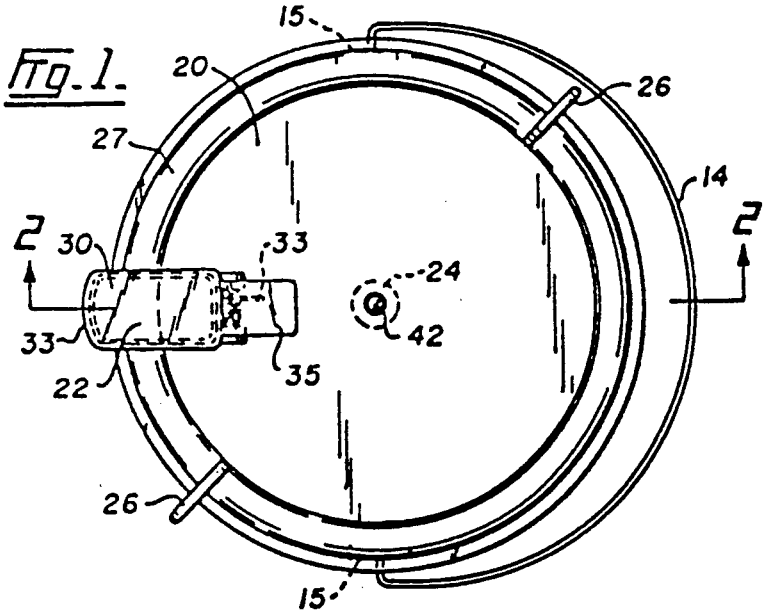
FIG. 1 is a plan view of a preferred embodiment of the present invention.
Figure 4:
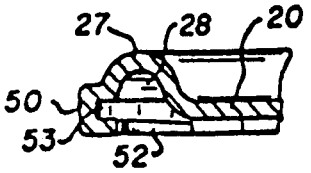
FIG. 4 is a view of the wedge locking tabs on the cover.

Removable cover 20 is best shown in FIG. 1 with sealable spout 22 at one edge of the cover and stirring arm support housing 24 mounted on the underside at the centre of the cover. The circumference of cover 20 is bounded by raised lip 27 with internal channel 28 having a semi-circular cross section shaped to fit over lip 10 of the main body. As is best shown in FIG. 4, raised lip 27 is shaped into a right angled lip 50 just below internal channel 28. Right angled lip 50 has a series of wedge tabs 52 spaced about the lower internal edge of the lip creating tapered channels 53 above each tab. Wedge tabs 52 are tapered in the opposite direction to wedge tabs 12 to main body 2. Handles 26 are used to rotate removable cover 20 after the cover has been placed atop main body 2. Rotating cover 20 causes wedge tabs 12 of main body 2 to engage wedge tabs 52 of the cover causing tabs 12 to become wedged in channels 53 of the cover thereby sealing the cover into place on the main body.

Sealable spout 22 is formed by walls extending upwardly around aperture 29 in cover 20. Angled fap 30 is pivotally connected to the top of cover 20 and serves to seal spout 22 as angled flap 30 is formed with an outer lip 32 which fits tightly about the walls of spout 22. Biasing spring 33 ensures that angled flap 30 is normally in the closed positioned as shown in FIG. 2. To open spout 22, pressure is applied to surface 35 of angled flap 30 to pivot the flap into the raised position shown by dashed lines in FIG. 2. It is understood that spout 22 may be formed into any adequate shape with a rectangular and circular cross section being described in the preferred embodiment. FIG. 1A shows a modified spout and flap with like numbers being primed.

Stirring arm in support housing 24 is molded to the underside of cover 20 to rotatably support shaft 42 of stirring arm 40. Shaft 42 extends from the interior of main body 2 through cover 20. The upper end of shaft 42 is keyed as shown in FIG. 2 to allow the shaft to be connected to a powered mixer 47. Helical blade 43 is mounted about shaft 42 and spans the diameter of the main body with adequate clearance of the side walls to allow the blade to freely rotate. Helical blade 43 is made from flexible plastic and is attached to shaft 42 by lower mounting bracket 44 fitted over the lower end of shaft 42 and by upper bracket 45. Lower mounting bracket 44 also supports wire stirrers 46 that extend essentially radially to shaft 42 at a slight downward angle of two degrees to match the slope of base 4. These stirrers are necessary to keep the lowest layer of fluid in the main body circulating so that it does not stagnate.

Before using the present invention, one can insert a formed plastic liner (not shown) corresponding to the internal shape of the main body 2. This liner extends above the upper edge of the main body and is folded over lip 10 before cover 20 is rotated in place to seal the main body. The plastic liner prevents the inner surface of the main body from coming into contact with the contents inside the plastic liner. Thus, the clean-up procedure necessary with the present invention is greatly simplified since all that is necessary for the plastic liner to be removed from the main body and discarded.

Figure 5:
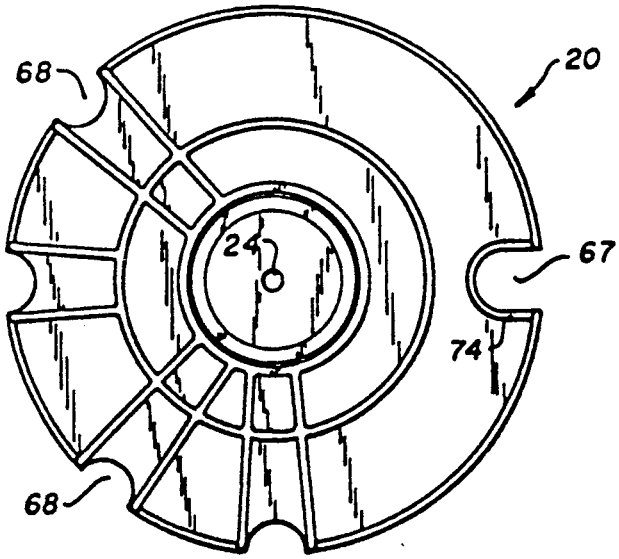
FIG. 5 is a plan view of the removable cover of a second embodiment of the present invention.
Figure 6:
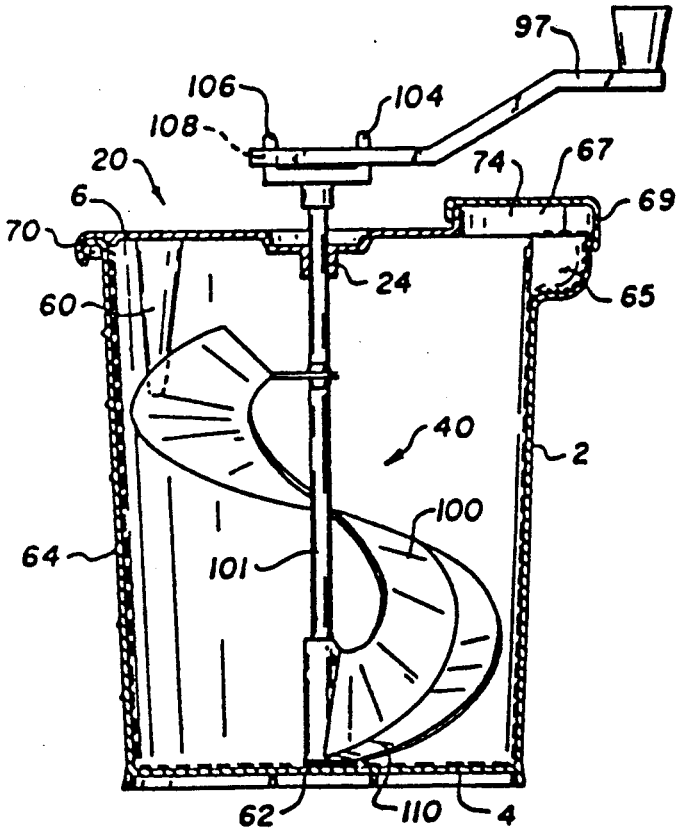
FIG. 6 is a section view through the second embodiment.

A second embodiment of the present invention is illustrated in FIGS. 5 and 6. In this second embodiment, parts analogous to the parts of the first embodiment are identically numbered. The use of a formed plastic liner is also presented.

The second embodiment comprises a paint mixing container having a slightly tapered main body 2, a removable cover 20 and stirring arm 40. Preferably, the main body has approximately a 5.5 liter capacity and a scale 64 is marked on the main body. Main body 2 has a plurality of tapered indentations 60 that extend downwardly from open top 6. Base 4 of the main body is recessed and formed with engagement tabs 62. Tapered indentations 60, recessed base 4 and engagement tabs 62 allow the main body to be secured in a conventional manner to standard power driven paint mixing machines.

A pouring spout 65 is formed in the main body of the container adjacent the open top 6. As best shown in FIGS. 5 and 6, removable cover 20 is formed with an opening 67 that aligns with spout 65 to allow pouring of fluids from the container. An independent sealing cap 69 is provided for fitting over opening 67 in order to seal pouring spout 65. Opening 67 is formed with a raised lip 74 which is engaged by sealing cap 69. If necessary, cover 20 can be provided with a filter member comprising a fine mesh screen 71 to filter fluids as they are poured from the container as shown in FIG. 6A.

Cover 20 is also formed with cutouts 68 spaced to align with tapered indentations 60 in the main body of the container. A central stirring arm support housing 24 is also formed in cover 20.

Figure 7:
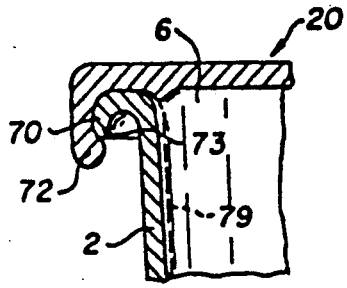
FIG. 7 is a detailed view of the locking arrangement between the removable cover and the main body of the second embodiment.

FIG. 7 shows a detailed view of the manner in which removable cover 20 is attached and locked to main body 2. Locking means are provided comprising a channel 70 formed about the periphery of removable cover 20 on the underside of the cover. Channel 70 is formed with an inwardly directed flange 72. A correspondingly formed lip 73 is provided about open top 6 of main body 2 designed to interfit with channel 70. When cover 20 is press fitted atop main body 2, flange 72 of cover 20 is sufficiently resilient to move outwardly about lip 73 and then inwardly to engage beneath the lip as shown to hold cover 20 firmly atop main body 2. Cover 20 is removed by reaching under lip 73 and applying an outward force on flange 72 to release the flange from under lip 73.

Figure 9:
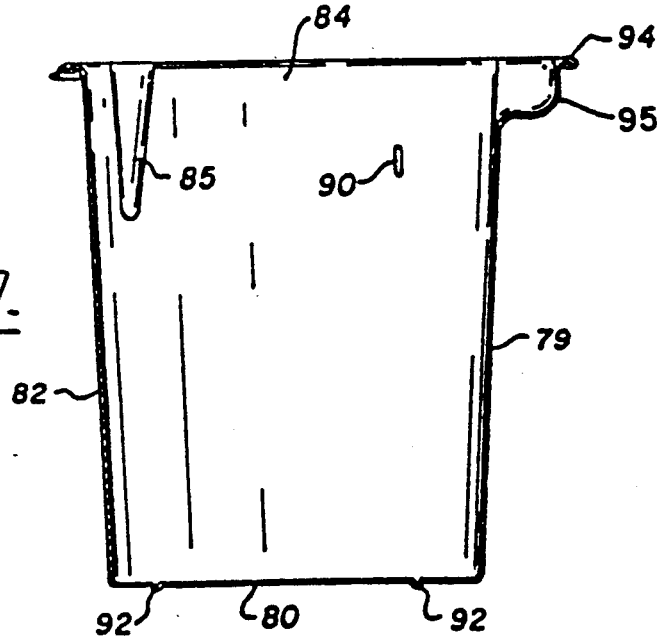
FIG. 9 shows the inner liner for insertion into the main body.

The embodiment of the present invention also includes a removable liner as shown in FIG. 9. Liner 79 comprises a thin walled self-supporting flexible shell having a base 80, side walls 82 and an open top 84 adapted to fit within main body 2. Tapered indentations 85 are formed in the side walls 82 to align with similar indentations 60 in the main body 2. This liner is placed inside the main body to protect the body from fluids held within the container. The liner is easily removable and provides for easy cleaning if desired. Alternatively, if the liner cannot be cleaned, it can discarded and replaced with a new liner.

Positioning means are provided to align and lock the liner shell into main body 2 comprising indentations 90 and projections 92 formed on the side walls and base of liner 79 and adapted to interfit with corresponding projections and indentations formed in main body 2. Liner 79 is also provided with a lip 94 about a open top 84 and a spout 95 that overlies lip 73 and spout 65 of main body 2 when the liner is inserted into the main body 2. In FIG. 7, liner 79 is shown by dashed lines and is clamped between cover 20 and main body 2 to assist in positively locating the liner within the main body.

Referring to FIG. 6, the paint mixing container of the second embodiment is provided with a removable manually rotatable handle 97 to operate stirring arm 40. As with the previous embodiments, stirring arm 40 comprises a helical blade 100 mounted to a shaft 101 rotatable in stirring arm support housing 24. An adapter 104 is mounted to the top of shaft 101 to accept rotatable handle 97. Adaptor 104 is formed with a pair of projections 106 that engage in holes 108 formed in handle 97.

Figure 8:
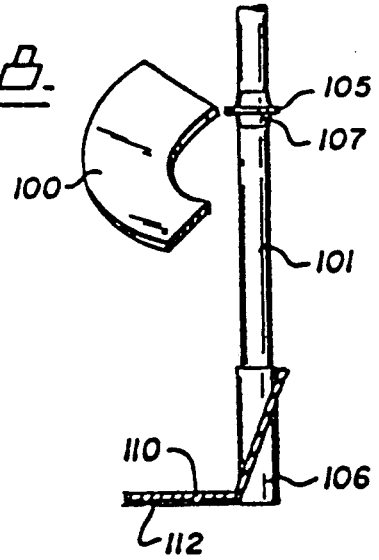
FIG. 8 is a section view through the helical blade used with the second embodiment of the present invention.

Helical blades 100 and shaft 101 are very similar to the arrangement of the first embodiment. Helical blade 100 is mounted about shaft 101 and spans the diameter of the main body with adequate clearance of the side walls and the liner to allow the blade to rotate freely. As best shown in FIG. 8, helical blade 100 is molded from flexible plastic and is attached to shaft 101 by mounting means comprising a lower bracket 106 that is fitted over the lower end of shaft 101. Helical blade 100 terminates at its upper end in radial tab 105 that is formed with an aperture 105A to engage in a notch 107 about shaft 101.

Lower bracket 106 and the lower portion of helical blade 100 include an integrally formed extension 110 adapted to extend radially to the axis of shaft 101 adjacent base 4 of main body 2 in order to ensure proper mixing of fluids at the bottom of the container. The underside of extension 110 is formed with ridges 112 to ensure complete mixing of the fluid.

Although the present invention has been described in some detail by way of example for purposes of clarity and understanding, it will be apparent that certain changes and modifications may be practiced within the scope of the appended claims.

I claim:

1. A paint mixing container comprising:

a main body of circular cross-section with a base, side walls and an open top, wherein said base is a cone having an apex at the center of the base and sides sloping downwardly to join with the side walls of the main body;

a stirring arm comprising a rotatable central shaft having a longitudinal axis with a helical blade rigidly mounted to the base thereof by a lower mounting member mounted about said central shaft, said helical blade extending upwardly and outwardly from said lower mounting member to smoothly connect said helical blade to said lower mounting member, said helical blade extending upwardly about said central shaft for one complete revolution of the shaft, the upper end of said helical blade being attached to said central shaft by an upper mounting member extending toward and encircling said central shaft, said upper mounting member comprises a radial tab engageable with a notch provided in said central shaft, said notch engaging said radial tab through an aperture carried by said radial tab;

a removable cover for covering the open top of said main body having a sealable opening and means to rotatably support said stirring arm in the interior of the main body, said main body further including a pouring spout formed alignable with said sealable opening in said removable cover;

locking means to allow said removable cover to be removably attached to the open top of said main body;

wherein said locking means comprises a channel formed about the periphery of said removable cover having an inwardly directed flange; and a correspondingly formed lip about said open top of said main body to interfit with said channel, said flange of said removable cover being adapted to engage and hold said lip in order to releasably hold said removable cover atop said main body when said cover is press fitted over said main body; and an independent sealing cap for fitting over said sealable opening in order to seal pouring spout.

2. A paint mixing container as claim in claim 1 in which the sloping sides of the base cone forms an angle of two degrees to the horizontal.

3. A paint mixing container as claimed in claim 1 in which the main body is made from plastic.

4. A paint mixing container as claimed in claim 1 in which said main body is fitted with disposable and flexible liner.

5. A paint mixing container as claimed in claim 4 in which said liner comprises a self-supporting flexible shell having a base, side walls and an open top adapted to fit within said main body with positioning means to align and lock said shell into said main body.

6. A paint mixing container as claimed in claim 5 in which said positioning means comprises indentations and projections formed in said shell adapted to interfit with corresponding projections and indentations formed in said main body.

7. A paint mixing container as claimed in claim 5 in which said shell is formed with a lip about said open top to overlie said lip of said main body.

8. A paint mixing container as claimed in claim 1 in which said lower mounting member for said helical blade is a tubular boss which fits about the base of said central shaft.

9. A paint mixing container as claimed in claim 1 in which said helical blade is made from flexible plastic.

10. A paint mixing container as claimed in claim 1 in which said means to support said stirring arm is a tubular shaft support mounted to said cover and adapted to rotatably hold the upper portion of the central shaft of said stirring arm so that the central shaft extends through the cover and into the interior of the main body where the helical blade is attached for stirring the contents held in the main body.

11. A paint mixing container as claimed in claim 1 in which said central rotatable shaft has a keyway at its upper end to allow powered rotary driving means to be attached thereto.

12. A paint mixing container as claimed in claim 1 including indentations formed in said side walls and a recessed base to allow said main body to be held by conventional paint mixing machines.

13. A paint mixing container as claimed in claim 1 including a removable, manually rotatable handle to operate said stirring arm.

14. A paint mixing container as claimed in claim 1 in which said mounting means and said helical blade include an integrally formed extension member adapted to extend radially to the longitudinal axis of said central shaft adjacent the base of said main body to ensure proper mixing of material adjacent the base of said main body.

15. A paint mixing container as claimed in claim 14 further including ridge means carried by the underside of said extension member.

16. A paint mixing container as claimed in claim 1 including a filter member carried by said paint mixing container, extending over said sealable opening.

* * * * *

UNITED STATES PATENT AND TRADEMARK OFFICE

CERTIFICATE OF CORRECTION

PATENT NO. : 5,094,543

DATED : March 10, 1992

INVENTOR(S) : Laszlo Murzsa

It is certified that error appears in the above-identified patent and that said Letters Patent is hereby corrected as shown below: On the title page:

Item [76] "Inventor: Mursa" should read "Inventor: Murzsa"

Col. 1, line 54 "powdered" should read "powered"

Col. 2, line 42 "edge lip" should read "edge of lip"

Col. 2, line 67 "fap" should read "flap"

Col. 3, line 38 "necessary for" should read necessary is for"

Col. 4, line 31 "can discarded" should read "can be discarded"

Col. 5, claim 1, line 54 "seal pouring" should read "seal said pouring"

Col. 5, claim 2, line 55 "as claim" should read "as claimed"

Col. 6, claim 4, line 4 "with disposable" should read "with a disposable"

Signed and Sealed this

Twenty-first Day of September, 1993

Bruce Lehman

*Attest:*

BRUCE LEHMAN

*Attesting Officer*

*Commissioner of Patents and Trademarks*